US005310187A

United States Patent [19]

Yamaguchi et al.

[11] Patent Number: 5,310,187

[45] Date of Patent: May 10, 1994

[54] GOLF PUTTING AND CHIPPING PRACTICE DEVICE

[76] Inventors: Kenneth Yamaguchi; Michael Yamaguchi; Monica Ambrose, all of 101 S. Martel Ave., Los Angeles, Calif. 90036

[21] Appl. No.: 139,537

[22] Filed: Oct. 20, 1993

[51] Int. Cl.[5] ..... A63B 69/36

[52] U.S. Cl. ..... 273/177 R; 273/181 A; 273/180

[58] Field of Search ..... 273/177 R, 177 A, 177 B, 273/178 R, 178 A, 127 R, 127 B, 181 A, 184 A, 184 R, 185 R, 180

[56] References Cited

U.S. PATENT DOCUMENTS

| | | | |
|---|---|---|---|
| 2,236,572 | 4/1941 | King | 273/127 R |
| 3,184,240 | 5/1965 | Gleeson | 273/177 A |
| 3,647,216 | 3/1972 | Breslow | 273/178 R X |
| 4,295,650 | 10/1981 | Keeble | 273/127 B X |
| 4,667,964 | 5/1987 | Hickey | 273/176 F |

*Primary Examiner*—George J. Marlo

*Attorney, Agent, or Firm*—Poms, Smith, Lande & Rose

[57] ABSTRACT

A self supporting golf target device for use in practicing putting and chipping. The target device presents a golf target hole to the golfer with no impediment to a ball entering the hole through a 360° angle. The device has three sidewalls meeting at one arcuately shaped end, each arcuately shaped end forming ⅓ of the target hole.

10 Claims, 2 Drawing Sheets

GOLF PUTTING AND CHIPPING PRACTICE DEVICE

BACKGROUND OF THE INVENTION

1. Field of the Invention

The invention relates to golf; and, more particularly, to a target device to be used to simulate a hole for practicing putting and chipping.

2. Description of the Prior Art

Various types of golf putting devices have been suggested over the years. Many such devices have an edge above ground level that interferes with a rolling golf ball. Some of these devices provide a target hole without such obstructing edge but do not provide a hole or target opening 360° around the target.

SUMMARY OF THE INVENTION

It is an object of this invention to provide an improved golf target device for practicing chipping and putting.

It is a further object of this device having no impediment leading into the target hole.

It is still further an object of this invention to provide such a target device wherein the target hole is accessible 360° around the target hole.

These and other objects are preferably accomplished by presenting a golf target hole to the golfer with no impediment to a ball entering the hole through a 360° angle. The device has three sidewalls meeting at one arcuately shaped end, each arcuately shaped end forming one-third of the target hole.

DESCRIPTION OF THE PREFERRED EMBODIMENT

Figure 1:
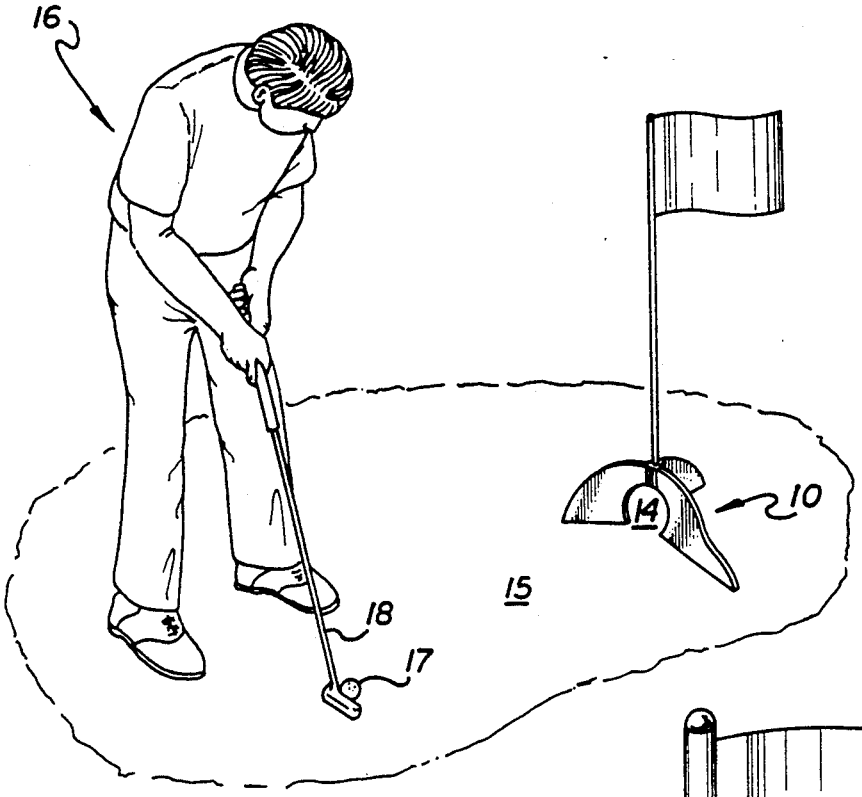
FIG. 1 is a perspective view of a portion of a putting green having a target device in accordance with the teachings of the invention disposed thereon.

Referring now to FIG. 1 of the drawing, a golf target 10 in accordance with the teachings of the invention is shown. Target 10 is shown disposed on a portion of a green 15 or other suitable generally horizontal playing area presenting a target hole 14 to the golfer 16. The golfer 16 in FIG. 1 is about to hit ball 17, using putter 18, into hole 14.

Figure 2:
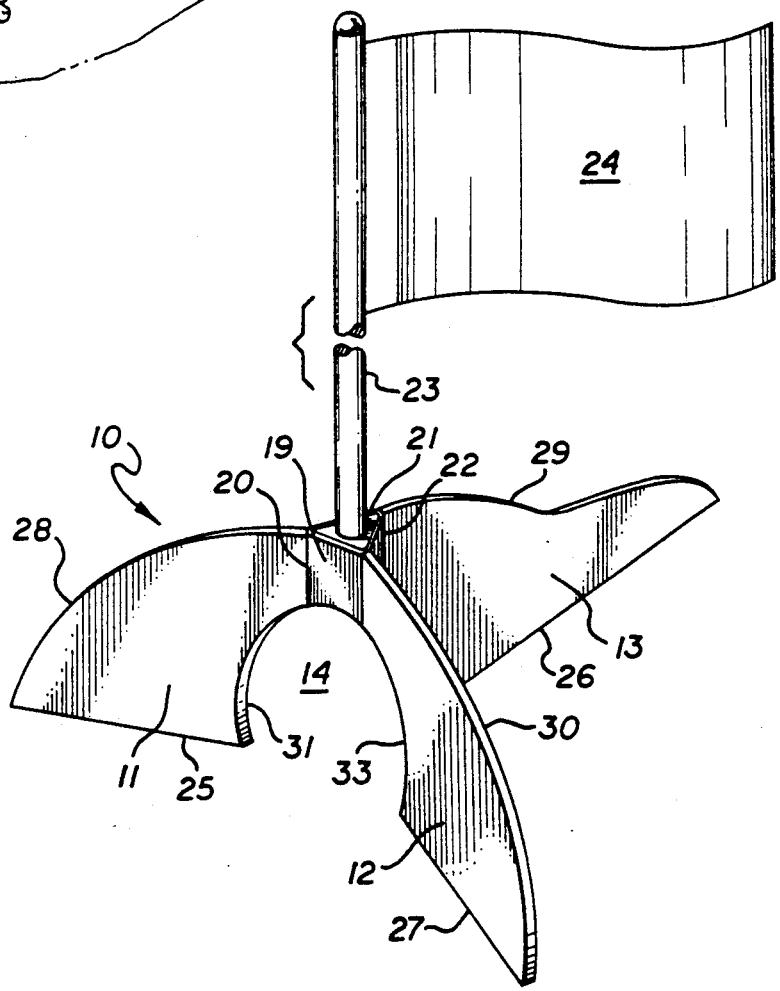
FIG. 2 is a perspective view of the target device alone of FIG. 1.

As seen in FIG. 2, target device 10 has three legs or sidewalls 11 through 13 radiating outwardly from a central point. This central point may be provided in the form of a block 19 triangularly shaped in cross section having spaced apices 20 through 22. As seen in FIG. 2, the faces of block 19 are slightly arcuate in cross-section to match the smooth round line of a golf hole. A pole 23 is mounted in the center of block 19 having flag 24 mounted at top. Thus, a plurality of target devices 10 may be disposed about a putting green or the like each having a flag with suitable differing identifying indicia thereon (e.g., hole 1, hole 2, hole 3, etc.).

Figure 4:
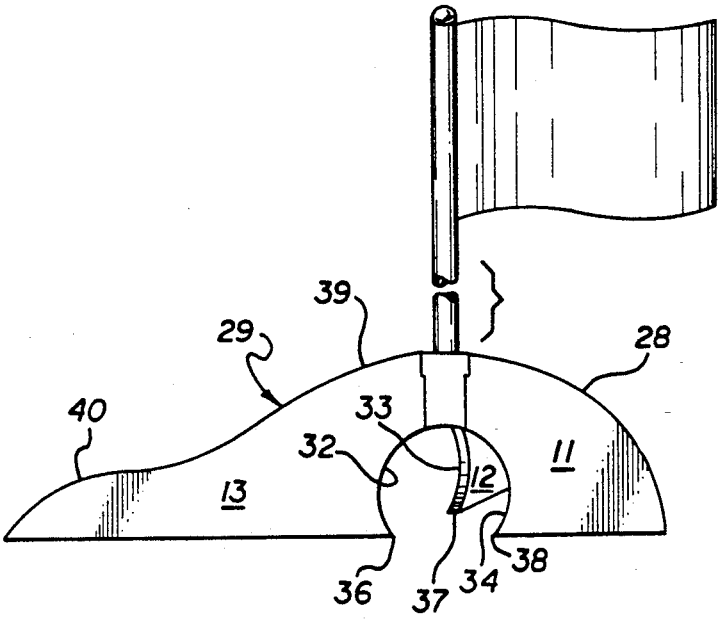
FIG. 4 is an elevational view of the device of FIG. 1.
Figure 3:
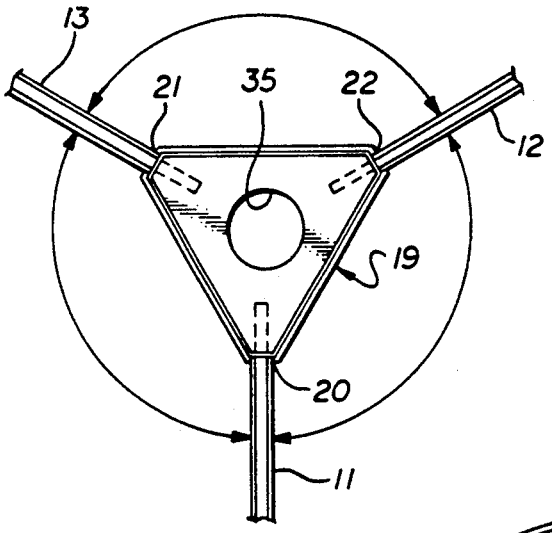
FIG. 3 is a top plan view of the device of FIG. 1.

As seen in FIG. 2, each sidewall 11 through 13 has a flat bottom wall (e.g., walls 25 through 27, respectively), an upper and outer curved wall (e.g., walls 28 through 30, respectively) and an inner arcuate wall segment (e.g., wall segments 31 through 33, respectively) - see FIG. 4 for wall segment 32 that is not visible in FIG. 2. Each side wall 11 through 13 is connected to an apex of block 19 as particularly seen in FIG. 3. Thus, the center of hole 35 in FIG. 3 (pole 23 having been removed) is essentially coincident with the central zone of through hole 14 in FIGS. 1 and 2 (hole 14 being defined by an imaginary line passing through points 36 through 38 as seen in FIG. 4.

Also as seen in FIG. 4, curved wall 29 has a first upper curved portion 39 extending downwardly to a lower curved portion 40. The overall length of side wall 13 is greater than the overall length of side walls 11, 12 to provide greater stability and support.

Although sidewalls 11 to 13 and block 19 may be of one piece, preferably side walls 11 to 13 may interconnect to block 19 so it can be knocked down for shipping or the like.

Figure 5:
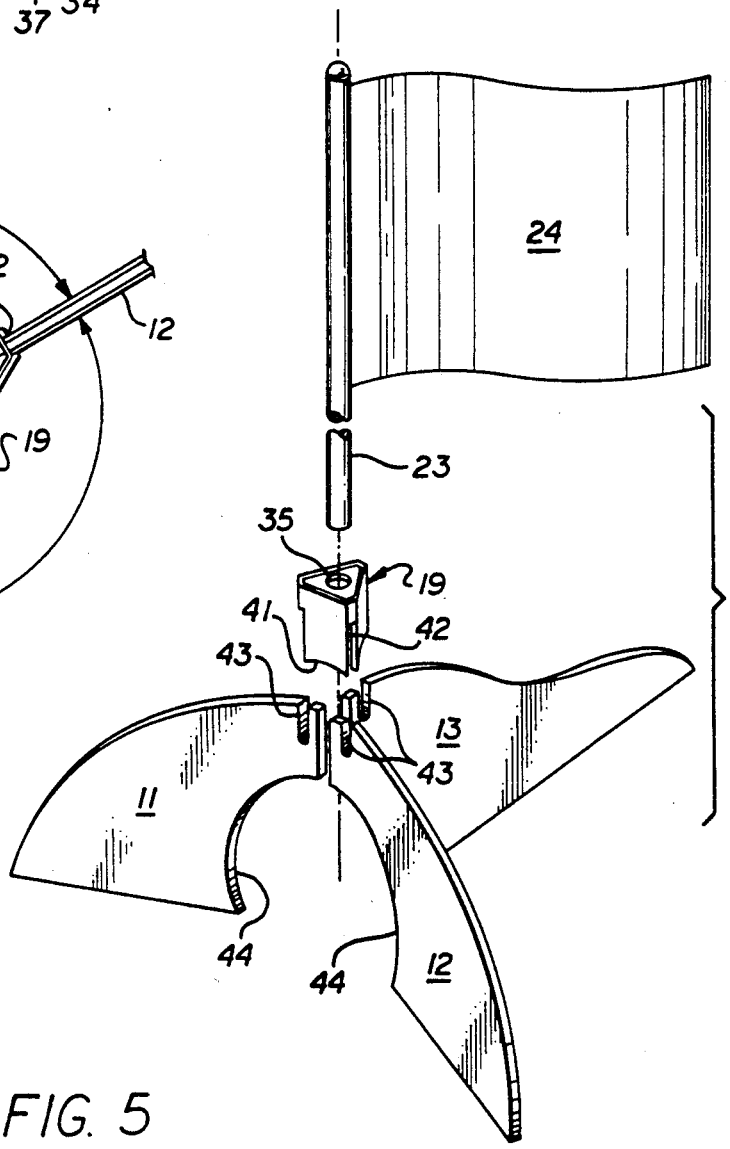
FIG. 5 is an exploded view illustrating one form of assembly of parts making up the device of Fig. 1.

Thus, block 19 may be hollow on the interior 41 (FIG. 5) with a slot 42 in each corner. Each side wall 11 through 13 has a mating slot 43 in the end where the side walls 11 through 13 interconnect to block 19. As seen in FIG. 5, slots 42 are receivable in slots 43 resulting in the assembled condition shown in FIG. 2.

Of course, various methods of interconnecting side walls 11 to 13 to block 19 may occur to an artisan. Also, block 19 may have any number of cross-sectional variations, the only requirement being that the side walls 11 to 13 are connected thereto in the spacing relationship shown in FIG. 3.

The target device 10 is portable and can be quickly and easily assembled and set up on a carpet, lawn or the like. It can be used to practice various golf shots such as putting, chipping and pitching. Device 10 is self supporting and presents a vertically oriented target with a completely unobstructed target hole exactly at ground level. The degree of "feel" for all types of golf shots is increased.

Hole 14 is accessible from any directional orientation 360° around device 10. There is no impediment to the rolling of a golf ball to the hole 14.

Hole 14 looks like an actual golf hole that is essentially circular in outline and oriented vertically. If desired, as seen in FIG. 5, painting or striping 44 may be added about the rim of hole 14 to aid in visibility.

The diameter of the opening defined by points 36, 38; 37, 38; and 36, 38 at ground level may be about 4.25 inches. Of course, these openings may be widened to make the target easier to hit, e.g., 1.75 inches wider.

The upper curved walls of device 10 represents the shape of an actual golf course green with gently curving outlines surrounding the target hole. It is shaped to resemble a kidney-shaped golf green as seen from the golfer's perspective with the flag pole at back of the green.

The device 10 may be modular and sectioned for quick assembly and disassembly. Any suitable knock-down and/or assembly means may be used.

As seen in FIG. 2, three distinct legs 11 to 13 are used with one leg (13) longer than the others. Any suitable materials may be used such as plywood, cardboard, chipboard, plastics, etc.

A large variety of games can be played using target device 10. Any suitable dimensions may be used. For example, device 10 may be about 7 ½ inches in height (up to the top of block 19) and about 16 inches in width. Legs 11 and 12 may be about 10 inches in length with leg 13 about 16 inches in length.

It can be seen that there is disclosed a self supporting vertically oriented target device 10 which can be used from any angle and 360° therearound. Target device 10 has three vanes or sidewalls 11 through 13, each comprising ⅓ of the target hole 14 formed by the intersection of the sidewalls 11 through 13. These sidewalls 11 through 13 have one end joined at a single central point forming a tri-radial or y shaped platform. The shape of device 10 is different and unique; it has an asymmetrical three-legged arrangement, the outlines of which resemble an actual golf course putting green as seen from the point of the golfer.

Although a particular embodiment of the invention is disclosed, variations thereof may occur to the artisan and the invention is to be limited only by the scope of the appended claims.

I claim:

1. A self supporting golf target device for practicing putting and chipping or the like comprising:

a first elongated side wall having a bottom wall, a top wall, a first outer end and a second inner end and an arcuate cut-out section at said second inner end;

a second elongated side wall having a bottom wall, a top wall, a first outer end and a second inner end and an arcuate cut-out section at said last mentioned second inner end;

a third elongated side wall having a bottom wall, a top wall, a first outer end and a second inner end and an arcuate cut-out section at said last mentioned second inner end; and a block member interconnecting the inner ends of said first, second and third side walls and spacing the plane of one of said side walls about 120° from the plane of an adjacent other of said side walls with the arcuate cut-out section of one of said side walls cooperating with the arcuate cut-out section of an adjacent other of said side walls to form a substantially semicircular opening leading into the center of said device with no obstruction between adjacent second inner ends of said side walls.

2. In the device of claim 1 wherein the top walls of said first and second elongated side walls are arcuate curving outwardly and downwardly from said block member.

3. In the device of claim 2 wherein the top wall of said third elongated side wall curves first outwardly and downwardly from said block member, then upwardly and outwardly, then again downwardly and outwardly to said outer end thereof.

4. In the device of claim 1 wherein said first and second elongated side walls are substantially the same overall length.

5. In the device of claim 4 wherein said third elongated side wall is greater in overall length than said first and second elongated side walls.

6. In the device of claim 1 wherein said block member is generally triangular in cross section, said side walls being connected to spaced apices thereof.

7. In the device of claim 6 wherein said side walls are removably connected to said block member.

8. In the device of claim 1 wherein said side walls are removably connected to said block member.

9. In the device of claim 1 wherein the inner ends of said side walls where said inner ends intersect said respective bottom walls curve inwardly toward each other.

10. In the device of claim 1 wherein a vertical flag pole is mounted on said block member.

* * * * *